United States Patent [19]

Mednick et al.

[11] Patent Number: 4,530,671

[45] Date of Patent: Jul. 23, 1985

[54] TOY FIGURE WITH EXTENDING NECK

[75] Inventors: Mel Mednick, New City; Karyn Weiss, New York, both of N.Y.

[73] Assignee: L.J.N. Toys, Ltd., New York, N.Y.

[21] Appl. No.: 461,733

[22] Filed: Jan. 28, 1983

[51] Int. Cl.[3] ..... A63H 3/36

[52] U.S. Cl. ..... 446/320; 446/378

[58] Field of Search ..... 248/414, 297.5; 446/320, 330, 338, 339, 376, 378, 391, 384

[56] References Cited

U.S. PATENT DOCUMENTS

| | | | |
|---|---|---|---|
| 168,710 | 10/1875 | Blodget | 248/414 |
| 863,270 | 8/1907 | Fiedeler | 46/119 X |
| 1,557,023 | 10/1925 | Chinn | 46/135 R |
| 1,591,905 | 7/1926 | Williams | 46/151 |
| 1,683,561 | 9/1928 | Letson | 446/320 X |
| 2,623,329 | 12/1952 | Di Leva | 46/173 X |
| 2,767,516 | 10/1956 | Del Mas | 46/151 |
| 2,808,681 | 10/1957 | Arenstein | 46/173 |
| 3,235,259 | 2/1966 | Glass et al. | 46/142 |
| 3,265,346 | 8/1966 | Petrick | 248/414 |
| 3,292,610 | 12/1966 | Newman | 46/232 |
| 4,111,484 | 9/1978 | Jaeger | 248/414 |
| 4,136,481 | 1/1979 | Nicholls | 46/22 |
| 4,182,075 | 1/1980 | James | 46/118 |
| 4,246,722 | 1/1981 | Sapkus et al. | 46/135 R |

FOREIGN PATENT DOCUMENTS

| | | | |
|---|---|---|---|
| 810368 | 8/1951 | Fed. Rep. of Germany | 46/135 R |
| 1050254 | 2/1959 | Fed. Rep. of Germany | 446/378 |
| 385442 | 3/1965 | Switzerland | 248/295 C |

*Primary Examiner*—Mickey Yu

*Attorney, Agent, or Firm*—Amster, Rothstein & Engelberg

[57] ABSTRACT

A toy figure having a head with an elongated neck and skull, and a body having an orifice for slideably receiving the neck so that the neck can extend from and retract within the body. The outward movement of the neck is limited by a stop member and guided by a tab and slot. The skull has a heavy portion which is eccentrically positioned with respect to the axis of the neck.

6 Claims, 5 Drawing Figures

FIG. 1.
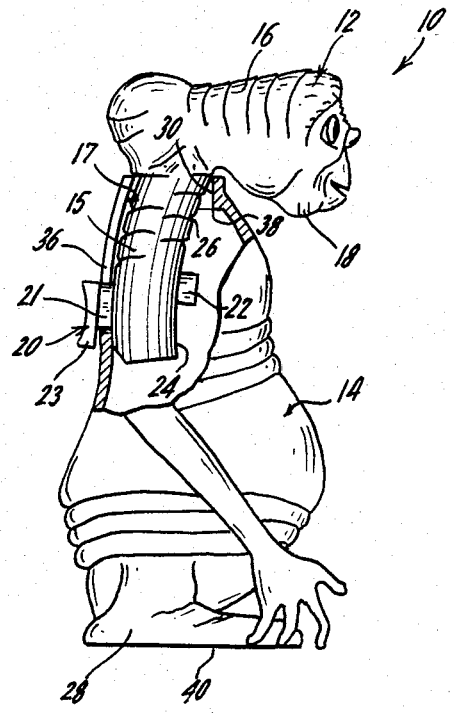
FIG. 2.
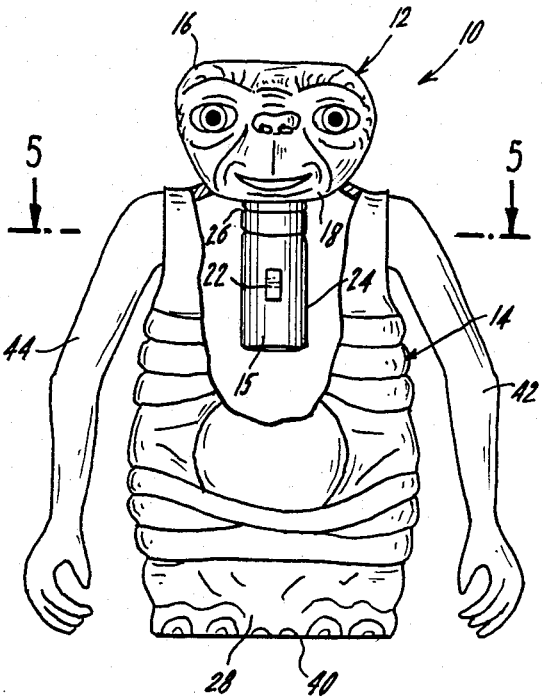
FIG. 3.
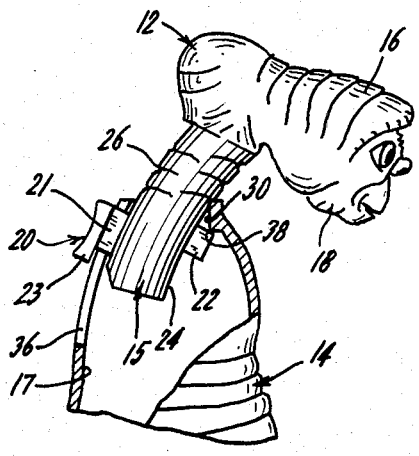
FIG. 4.
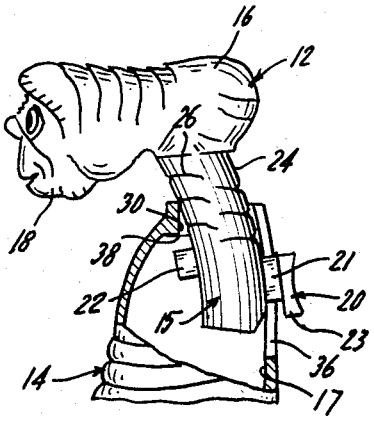
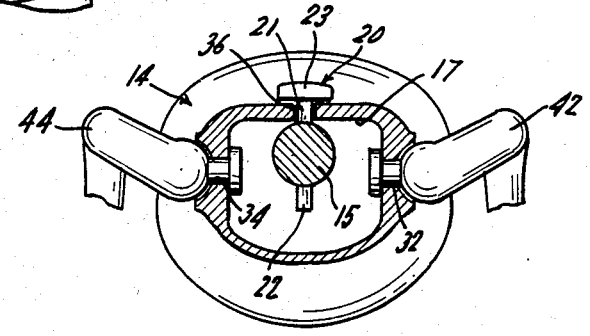
FIG. 5.

TOY FIGURE WITH EXTENDING NECK

BACKGROUND OF THE INVENTION

This invention relates to a toy figure, and more specifically to a toy figure having an extendable neck. Such a figure provides enhanced play value as compared to conventional toy figures.

Toy figures with extendable necks have been known in the art, but such prior figures either utilize special stretchable materials which are expensive and lacking in rigidity or involve complex mechanical linkages which are prone to failure and costly.

SUMMARY OF THE INVENTION

The present invention overcomes the disadvantages associated with prior toy figures with extendable necks by providing a mechanically simple apparatus which may be suitably made from a wide variety of inexpensive materials, while maintaining structural rigidity.

Considered broadly, the toy figure advantageously includes two sections, first, a head member having an elongated neck and second a body member having a top orifice for slidably receiving the elongated neck so that it may extend from or retract within the body member.

Accordingly, it is an object of this invention to provide a toy figure with an extendable neck which obviates one or more of the disadvantages of the prior art and produces improved results.

It is a further object of the present invention to provide a toy figure with an extendable neck using a simplified and inexpensive mechanical structure.

It is still a further object of the present invention to provide a toy figure with an extendable neck which may be manufactured from a wide variety of inexpensive materials.

It is yet a further object of the present invention to provide a toy figure with an extendable neck while maintaining structural rigidity.

In accordance with the present invention, there is provided a head member having an elongated neck portion and a skull portion and a body member having a top orifice for slidably receiving the neck portion so that the neck portion can extend from and retract within the body member. The head member has a skull portion which has a heavy portion eccentrically positioned with respect to the axis of the neck portion. The neck portion has a guide member and stop member. The body member has a bottom configured to stably support the figure in a generally upright position, a slot extending generally longitudinally along a portion thereof for engaging the guide member and a stop butt for restrainably engaging the stop member when the neck portion is extended to a predetermined outermost position. In a particular and illustrative embodiment demonstrating the objects and features of the present invention, the body is further provided with pivoting arm members on either side of the top orifice and the bottom of the body has a substantially flat surface and is configured to appear as legs.

BRIEF DESCRIPTION OF THE DRAWINGS

The above objects, aspects and advantages of the invention, as well as others, will be apparent from the detailed description of the preferred embodiment of the invention considered in conjunction with the drawings, which should be considered in an illustrative and not in a limiting sense, as follows:

FIG. 1 is a side elevational view in partial section showing the head member with its elongated neck and the body member of the toy figure;

FIG. 2 is a partial side elevational view in partial section of the toy figure of FIG. 1 showing the neck of the head member in a fully extended position;

FIG. 4 is a partial side elevational view in partial section of the toy figure of FIG. 1 showing the neck of the head member in a partially extended position; and FIG. 5 is a cross-section of the toy figure taken on line 5—5 of FIG. 2 showing the pivotable arm members in place.

DETAILED DESCRIPTION OF THE DRAWINGS

Referring to FIG. 1, the complete toy figure 10 having head member 12 and hollow body member 14 is shown. The head member 12 has an elongated neck 15, with a longitudinal surface 24 and a skull 16. The skull 16 has a heavy portion 18 which is positioned eccentrically with regard to the axis of the neck 15. The neck 15 is provided with a guide member 20 and stop member 22 on its longitudinal surface 24. The longitudinal surface 24 of the neck 15 is roughened by a plurality of latitudinal notches 26. The guide member 20 includes, a tab 21 and a thumb button 23.

As seen in FIGS. 1 and 2, the body 14 includes a bottom portion 28, a top orifice 30, opposing side orifices 32 and 34, a longitudinal slot 36 and a stop butt 38. The bottom portion 28 is provided with a substantially flat surface 40 which supports the figure 10 in a generally upright position. bottom portion 28 is provided with a substantially flat surface 40 which supports the figure 10 in a generally upright position.

As best seen in FIGS. 3 and 4, the neck 15 is slidably received by the top orifice 30 so that the neck 15 can extend from and retract within the body member 14 as the tab 21 of the guide member 20 rides within the slot 36. The rear interior surface 17 of the body member 14 is configured to generally abut at least a segment of the longitudinal surface 24 when the neck 15 is in any given position. Since the heavy portion 18 of the skull 16 is eccentrically positioned relative to the axis of the neck 15, the neck 15 is urged to pivot about the periphery of the top orifice 30 and the longitudinal surface 24 of the neck 15 opposite the heavy portion 18 of the skull 16 is urged against the rear interior surface 17 of the body member 14. Accordingly, when the head member 12 is placed in any selected position, it is held in place by frictional engagement between the longitudinal surface 24 of the neck 15 and the rear interior surface 17 of the body member 14. This retention is aided by the latitudinal notches 26 which both increase the coefficient of friction of the longitudinal surface 24 and act as detents which engage the periphery of the top orifice 30. As seen in FIG. 3, the second tab 22 engages the restraining butt 38 when the neck 15 is extended to a predetermined outermost extended position and thereby prevents further extension. Movement of the head member 12 from position to position can easily be accomplished by manipulation of the thumb button 23 of the guide member 20.

Referring to FIG. 5, the pivotable arms 42 and 44 are shown. Pivotable arms 42 and 44 are held within side orifices 32 and 34 by conventional means.

It should be understood that the embodiment described herein is only illustrative of the present invention, and it should be recognized by those skilled in the art that, for example, the invention may also be practiced in other configurations. Accordingly, a latitude of modification, change and substitution is intended in the foregoing disclosure. Accordingly, it is appropriate that the appended claims be construed broadly and in a manner consistent with the spirit and scope of the invention.

What is claimed is:

1. A toy figure, comprising:

a body member;

a head member having an elongated neck and a skull, said skull having a heavy portion eccentrically positioned with respect to the axis of said neck to urge said neck into frictional engagement with said body member, said neck having first and second tab members on its longitudinal surface, said first tab member being positioned opposite said heavy portion; and said body member having a bottom configured to stably support the figure in a generally upright position, a top orifice for slidably receiving said neck so that said neck can extend from and retract within said body member, a slot means extending generally longitudinally along a portion of said body member for engaging said first tab member and a stop means for restrainably engaging said second tab member when said neck is extended to a predetermined outermost extended position.

2. The toy figure claimed in claim 1, wherein:

said body member is hollow and has an interior surface configured to abut at least a segment of said longitudinal surface of said elongated neck when said elongated neck is in any given extended position.

3. The toy figure claimed in claim 1, wherein:

said longitudinal surface of said neck is provided with a plurality of latitudinal notches.

4. The toy figure claimed in claim 1, wherein:

said bottom of said body member is substantially flat.

5. A toy figure, comprising:

a head member having an elongated neck and a skull, said skull having a heavy portion eccentrically positioned with respect to the axis of said neck;

a body member having an orifice for slidably receiving said neck so that said neck can extend from and retract within said body;

a longitudinal slot in said body member;

a guide member on said neck, said guide member being slidably movable within said longitudinal slot as said neck extends from and retracts within said body; and a stop means for preventing said neck from extending outwardly from said body member beyond a predetermined position.

6. A toy figure, comprising:

a head member having an elongated neck and a skull, said skull having a heavy portion eccentrically positioned with respect to the axis of said neck;

a body member having an orifice for slidably receiving said neck so that said neck can extend from and retract within said body;

a guide means for directing the sliding movement of said neck as it extends from and retracts within said body;

a stop means for preventing said neck from extending outwardly from said body member beyond a predetermined position;

said body member having an inner surface configured to abut at least a segment of said elongated neck when said elongated neck is in any given extended position; and said neck having a plurality of latitudinal notches about its surface which frictionally co-act with said inner surface of said body member.

* * * * *